US008111869B2

(12) United States Patent
Horigome et al.

(10) Patent No.: US 8,111,869 B2
(45) Date of Patent: Feb. 7, 2012

(54) SPEAKER DEVICE

(75) Inventors: Minoru Horigome, Tendo (JP); Hiroshi Sato, Tendo (JP); Takuei Nagasawa, Tendo (JP); Hiroya Oizumi, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 410 days.

(21) Appl. No.: 12/515,112

(22) PCT Filed: Nov. 17, 2006

(86) PCT No.: PCT/JP2006/323034

§ 371 (c)(1),
(2), (4) Date: May 15, 2009

(87) PCT Pub. No.: WO2008/059600

PCT Pub. Date: May 22, 2008

(65) Prior Publication Data

US 2010/0054524 A1 Mar. 4, 2010

(51) Int. Cl.
*H04R 1/00* (2006.01)
*H04R 9/06* (2006.01)
*H04R 11/02* (2006.01)

(52) U.S. Cl. ..... 381/404; 381/403; 381/412

(58) Field of Classification Search ..... 381/403, 381/413, 412, 405, 404

See application file for complete search history.

(56) References Cited

U.S. PATENT DOCUMENTS

| | | | | |
|---|---|---|---|---|
| 6,351,544 | B1 * | 2/2002 | Noll | 381/404 |
| 2001/0011615 | A1 * | 8/2001 | Iwasa et al. | 181/172 |
| 2005/0259843 | A1 * | 11/2005 | Horigome et al. | 381/430 |

FOREIGN PATENT DOCUMENTS

| | | |
|---|---|---|
| JP | 63-136500 | 9/1988 |
| JP | 2001-309489 | 11/2001 |
| JP | 2006-211469 | 8/2006 |
| JP | 2006-229300 | 8/2006 |
| JP | 2006-238077 | 9/2006 |

* cited by examiner

*Primary Examiner* — Walter L Lindsay, Jr.
(74) *Attorney, Agent, or Firm* — Young & Thompson

(57) ABSTRACT

A speaker device includes a damper allowing high linearity. The speaker device includes a vibration body including a damper and a voice coil bobbin (bobbin), and a magnetic circuit having a plate. The damper has a first member arranged opposite the plate, and a second member projecting on a side of the plate from the first member. The first member has a movable part elastically supporting the bobbin. The movable part is a flat plate, and behaves with respect to a bent part provided between the movable part and the second member with movement of the bobbin in an acoustic radiation direction and reverse. Therefore, when a constant force is given to the damper via the voice coil, a displacement of the damper with respect to a rest position can be substantially similar in such a case that the damper behaves in the acoustic radiation direction and the reverse.

13 Claims, 8 Drawing Sheets

SPEAKER DEVICE

TECHNICAL FIELD

The present invention relates to a configuration of a damper of a speaker device.

BACKGROUND TECHNIQUE

Conventionally, there is known a speaker device including: a cylindrical voice coil bobbin around which a voice coil is wound; a frame provided to surround the voice coil bobbin; and a corrugation-shaped damper (generally referred to as "corrugation damper") which is provided between an outer peripheral surface of the voice coil bobbin and the frame and whose plural mountain shapes are formed on an acoustic radiation side and an side reverse thereto. In the speaker device of this kind, the voice coil is arranged at an appropriate position in a magnetic gap by the damper, and the damper has a function to elastically support the voice coil bobbin.

There is also known a speaker device including a damper arranged not on the outer side of the voice coil bobbin but in a space prescribed by the voice coil bobbin, (see Patent References-1 to 3, for example).

Patent Reference-1: Japanese Patent Application Laid-open under No. 2006-211469

Patent Reference-2: Japanese Utility Model Application Laid-open under No. S63-136500

Patent Reference-3: Japanese Patent Application Laid-open under No. 2006-238077

DISCLOSURE OF THE INVENTION

Problem to be Solved by the Invention

The damper according to Patent References-1 and 2 has the corrugation shape, whose plural mountains are formed on the acoustic radiation side and on the side reverse to the acoustic radiation side. In the damper, the number of mountains formed on the acoustic radiation side is usually different from the number of mountains formed on the side reverse to the acoustic radiation side. Thus, when the speaker device drives, even if a constant force is given to the damper via the voice coil, the extension of the damper is different between the acoustic radiation direction and the reverse direction. That is, in this case, a displacement of the damper from a rest position becomes different in the two cases that the damper moves in the acoustic radiation direction and in the acoustic radiation direction or the direction reverse thereto.

Originally, so as to improve sound quality, it is desired that a function indicating a relation between a force operating on the damper and a scale of the displacement of the damper extending by receiving the force is a soaring function and its gradient is constant. (As for the function, an X-axis indicates the force operating on the damper, and a Y-axis indicates the scale of the displacement of the damper. Additionally, the origin indicates such a state that the damper rests, and it is prescribed that the force operating on the damper at this time and the displacement of the damper are zero).

However, as for the damper according to Patent-References-1 and 2, there are two kinds of {(force operating on damper) vs. (displacement of damper)} curves by the above-mentioned operation, as shown in FIG. 8: one is a curve G1 whose gradient is constant from an origin O to a displacement B' point; and another is a curve G2 whose gradient is constant from the origin O to a displacement A' point, but whose gradient is not constant (rather downside) from the displacement A' point to the displacement B' point. Hereinafter, it is prescribed that "a linearity characteristic is high" as to the curve G1 and "the linearity characteristic is low" as to the curve G2.

By the way, the damper according to Patent References-1 and 2 has such a problem that the linearity characteristic is low.

The damper according to Patent Reference-3 does not have plural corrugation shapes. However, as for the damper, a thick movable part is formed, outwardly from the cylindrical supporting part, and a length of the movable part of the damper in the direction orthogonal with respect to the acoustic radiation direction is small. Therefore, there are some problems. For example, the movable part of the damper hardly behaves in the acoustic radiation direction and the direction reverse thereto, and the voice coil bobbin connected to the movable part hardly behaves.

The above problems are pointed as an example of an object which the present invention solves. It is an object of this invention to provide a speaker device comprising a damper mainly capable of obtaining a high linearity characteristic.

In the invention according to claim 1, a speaker device includes: a vibration body including a damper and a voice coil bobbin; and a magnetic circuit, wherein the damper includes a first member arranged opposite to the magnetic circuit and a second member provided to project toward the magnetic circuit from the first member, wherein the first member of the damper includes a movable part which elastically supports the voice coil bobbin, and the movable part is provided to extend toward the voice coil bobbin from a bent part formed between the movable part and the second member, wherein an outer peripheral part of the movable part is mounted on an inner peripheral surface of the voice coil bobbin, and the second member of the damper is arranged on the magnetic circuit, and wherein the movable part of the damper has a flat plate shape, and behaves with respect to the bent part with a movement of the voice coil bobbin to an acoustic radiation direction and a direction reverse to the acoustic radiation direction.

In the invention according to claim 2, a speaker device includes: a supporting body; and a vibration body including a damper supported by the supporting body and a voice coil bobbin, wherein the supporting body is provided to surround the voice coil bobbin, wherein the damper includes the first member, having an annular shape, arranged opposite to an outer peripheral surface of the voice coil bobbin and a second member provided to project toward the supporting body from the first member, wherein the first member of the damper includes a movable part which elastically supports the voice coil bobbin, and the movable part is provided to extend toward the voice coil bobbin from a bent part formed between the movable part and the second member, wherein an inner peripheral part of the movable part is connected to the outer peripheral surface of the voice coil bobbin, and the second member of the damper is connected to the supporting body, and wherein the movable part of the damper has a flat plate shape, and behaves with respect to the bent part with a movement of the voice coil bobbin to an acoustic radiation direction and a direction reverse to the acoustic radiation direction.

BRIEF DESCRIPTION OF THE REFERENCE NUMBER

Figure 1:
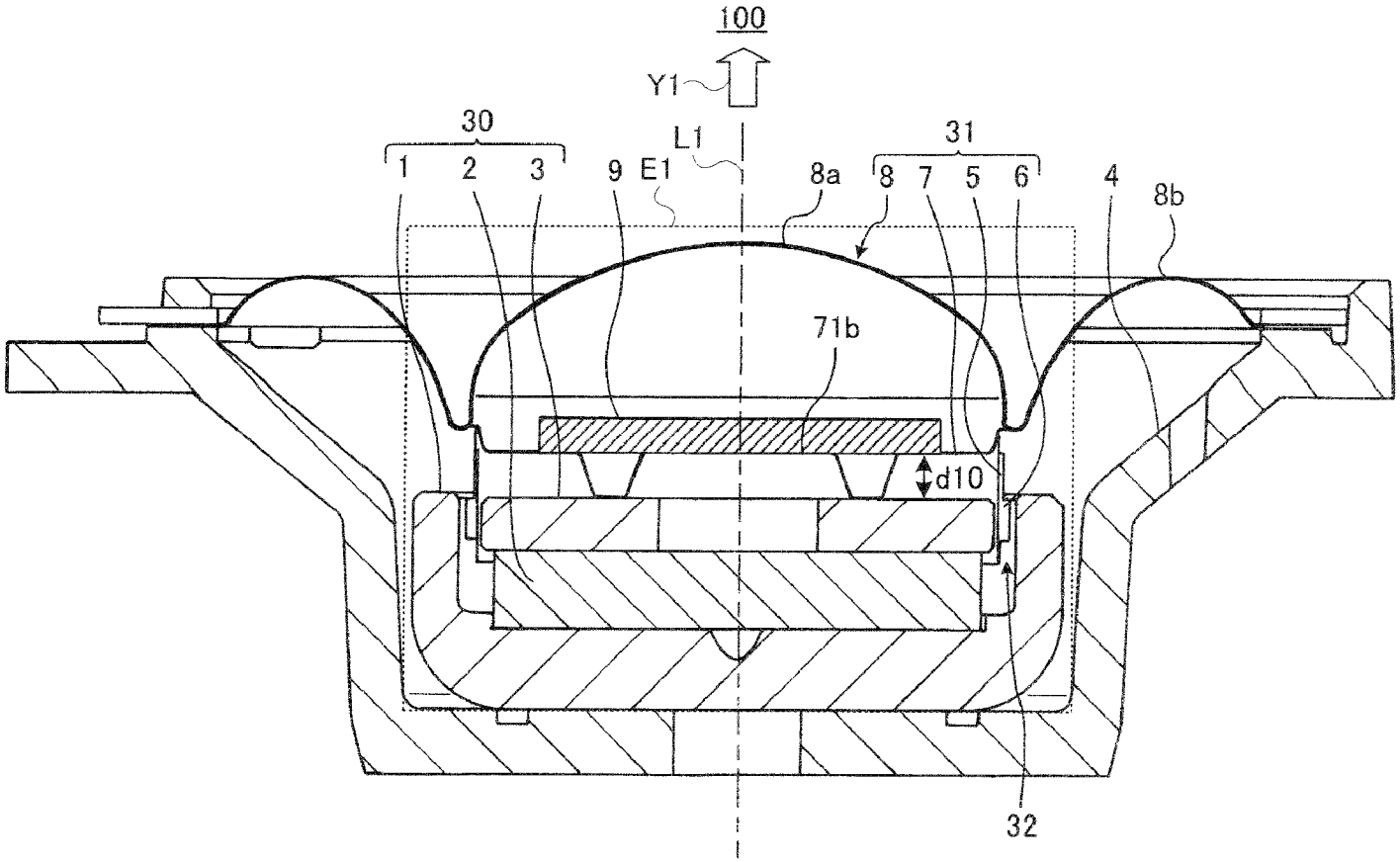
FIG. 1 is a cross-sectional view of a speaker device according to a first embodiment of the present invention.

3 Plate
4 and 4*x* Frame (vibration body)
5 and 5*x* Voice coil bobbin
7 and 7*x* Damper
8 and 8*x* Diaphragms
9 Sound absorbing material
71 and 71*x* First member
71*m* and 71*mx* Movable part
71*s* Flat part
71*h* Opening
72 and 72*x* Second member
73 and 73*x* Bent part
75 and 75*x* Folded part
30 and 30*x* Magnetic circuit
31 and 31*x* Vibration body
100 and 200 Speaker device

DETAILED DESCRIPTION OF THE PREFERRED EMBODIMENTS

According to one aspect of the present invention, there is provided a speaker device including: a vibration body including a damper and a voice coil bobbin; and a magnetic circuit, wherein the damper includes a first member arranged opposite to the magnetic circuit and a second member provided to project toward the magnetic circuit from the first member, wherein the first member of the damper includes a movable part which elastically supports the voice coil bobbin, and the movable part is provided to extend toward the voice coil bobbin from a bent part formed between the movable part and the second member, wherein an outer peripheral part of the movable part is mounted on an inner peripheral surface of the voice coil bobbin, and the second member of the damper is arranged on the magnetic circuit, and wherein the movable part of the damper has a flat plate shape, and behaves with respect to the bent part with a movement of the voice coil bobbin to an acoustic radiation direction and a direction reverse to the acoustic radiation direction.

The above speaker device comprises the vibration body including the damper and the voice coil bobbin, and the magnetic circuit. The damper includes the first member arranged opposite to the magnetic circuit and the second member provided to project toward the magnetic circuit from the first member. The first member of the damper has the movable part which elastically supports the voice coil bobbin. The movable part is provided to extend toward the voice coil bobbin from the bent part formed between the movable part and the second member. The outer peripheral part of the movable part is connected to the inner peripheral surface of the voice coil bobbin, and the second member of the damper is arranged on the magnetic circuit.

In a preferred example, the second member of the damper forms a predetermined gap between the first member and the magnetic circuit opposite to the first member, and the movable part can behave with respect to the bent part in the acoustic radiation direction and the direction reverse to the acoustic radiation direction.

Particularly, the movable part of the damper has the flat plate shape, and behaves with respect to the bent part with the movement of the voice coil bobbin in the acoustic radiation direction and the direction reverse to the acoustic radiation direction. Therefore, when the constant force is given to the damper via the voice coil, the displacement of the damper from the rest position can be substantially similar in such a case that the damper behaves in the acoustic radiation direction or the direction reverse thereto. Therefore, the high linearity characteristic can be obtained.

In addition, since the damper includes the movable part, the damper behaves more flexibly in correspondence with the movement of the voice coil bobbin, as compared with the corrugation-shaped damper (corrugation damper). Therefore, a rolling phenomena (rolling of the vibration body) can be suppressed.

In a manner of the above speaker device, the damper may be formed with a material in a film state. As the material in the film state, there is a thin resin film such as polyether imide (PEI), polypropylene, polyimide, polyphenylene sulfide, aramid and polycarbonate, for example.

Thereby, the movable part of the damper can easily follow the movement of the voice coil bobbin. In this point, the high linearity characteristic can be obtained. Also, thereby, since the weight of the damper can be reduced, the total weight of the vibration body can be reduced. Thus, the sensibility of the speaker device can be improved.

In another manner of the above speaker device, the vibration body may further include a diaphragm; the diaphragm may be arranged to cover the voice coil bobbin and the damper; the first member of the damper may have a flat part surrounded by the second member; and a sound absorbing material may be mounted on the flat part positioned on a side of the diaphragm.

The speaker device including no sound absorbing material at the flat part of the damper has a problem, which will be described below.

Namely, when the speaker device drives, since the damper moves with the voice coil bobbin, an unnecessary sound wave is radiated from the damper toward the diaphragm. At the same time, the sound wave is radiated from the diaphragm toward the damper, and the sound wave hits the damper to reflect. The unnecessary reflected sound wave is radiated toward the diaphragm. Moreover, at this time, the sound wave radiated from the diaphragm toward the damper causes the abnormal vibration to the damper. Thereby, the unnecessary sound wave is radiated from the damper toward the diaphragm. At this time, the unnecessary vibration occurring to the damper is transmitted to the diaphragm. Therefore, in the configuration, the sound quality deteriorates due to the above-mentioned unnecessary sound wave and vibration.

In this manner, since the sound absorbing material is mounted on the flat part of the damper, most of the unnecessary sound wave and vibration are absorbed by the sound absorbing material. The deterioration of the sound quality can be prevented.

In still another manner of the above speaker device, the vibration body may further include a diaphragm; the diaphragm may be arranged to cover the voice coil bobbin and the damper; the first member of the damper may have a flat part surrounded by the second member; a first space may be formed between the diaphragm and the damper, and a second space may be formed between the magnetic circuit and the flat part; and the first space and the second space may communicate with each other via an opening provided at the flat part.

If the volume of the first space formed between the diaphragm and the damper becomes large, the elasticity (hereinafter referred to as "force of air spring") of the compressed air in the first space becomes small. By using the force of the air spring, the low frequency reproduction limit can be lower. In this manner, since the second space is added to the first space, the volume of the space on the back side of the diaphragm becomes large by the amount. As a result, since the force of the air spring in the second space becomes small, the low frequency reproduction limit can be lower.

In still another manner of the above speaker device, the vibration body may further include a diaphragm; the diaphragm may be arranged to cover the voice coil bobbin and the damper; the first member of the damper may have a flat part surrounded by the second member; a first space may be formed between the diaphragm and the damper, and a third space may be formed between the movable part and the magnetic circuit; and the first space and the third space may communicate with each other via an opening provided at the movable part. Thereby, the third space is added to the first space, and the volume of the space on the back side of the diaphragm becomes much larger by the amount. As a result, the force of the air spring in the third space becomes small. Therefore, the low frequency reproduction limit can be lower.

In still another mariner of the speaker device, the outer peripheral part of the movable part may have a folded part folded in the acoustic radiation direction, and the folded part may be connected to the inner peripheral surface of the voice coil bobbin. Or, the outer peripheral part of the movable part may have a folded part folded in the direction reverse to the acoustic radiation direction, and the folded part may be connected to the inner peripheral surface of the voice coil bobbin. Namely, the folded part is preferably folded in the acoustic radiation direction or the direction reverse thereto. Thereby, a joint force between the damper and the voice coil bobbin can be enhanced.

According to another aspect of the present invention, there is provided a speaker device including: a supporting body; and a vibration body including a damper supported by the supporting body and a voice coil bobbin, wherein the supporting body is provided to surround the voice coil bobbin, wherein the damper includes the first member, having an annular shape, arranged opposite to an outer peripheral surface of the voice coil bobbin and a second member provided to project toward the supporting body from the first member, wherein the first member of the damper includes a movable part which elastically supports the voice coil bobbin, and the movable part is provided to extend toward the voice coil bobbin from a bent part formed between the movable part and the second member, wherein an inner peripheral part of the movable part is connected to the outer peripheral surface of the voice coil bobbin, and the second member of the damper is connected to the supporting body, and wherein the movable part of the damper has a flat plate shape, and behaves with respect to the bent part with a movement of the voice coil bobbin to an acoustic radiation direction and a direction reverse to the acoustic radiation direction.

The above speaker device comprises the supporting body, and the vibration body having the damper supported by the supporting body and the voice coil bobbin. The supporting body is provided to surround the voice coil bobbin. The damper has the first member, having an annular shape, arranged opposite to the outer peripheral surface of the voice coil bobbin and the second member provided to project toward the supporting body from the first member. The first member of the damper has the movable part which elastically supports the voice coil bobbin. The movable part is provided to extend toward the voice coil bobbin from the bent part formed between the movable part and the second member. The inner peripheral part of the movable part is connected to on the outer peripheral surface of the voice coil bobbin, and the second member of the damper is connected to the supporting body.

Particularly, the movable part of the damper has the flat plate shape, and behaves with respect to the bent part with the movement of the voice coil bobbin in the acoustic radiation direction and the direction reverse to the acoustic radiation direction. Therefore, when the constant force is given to the damper via the voice coil, the displacement of the damper from the rest position can be substantially similar in such a case that the damper behaves in the acoustic radiation direction and the direction reverse thereto. Therefore, the high linearity characteristic can be obtained.

In a manner of the above speaker device, the damper may be formed with a material in a film state. As the material in the film state, there is a thin resin film such as polyether imide (PEI), polypropylene, polyimide, polyphenylene sulfide, aramid, polycarbonate and so on, for example.

Thereby, the movable part of the damper can easily follow the movement of the voice coil bobbin. In this point, the high linearity characteristic can be obtained. In addition, thereby, since the weight of the damper can be reduced, the total weight of the vibration body can be also reduced. Thus, the sensitivity of the speaker device can be improved.

In another manner of the above speaker device, the inner peripheral part of the movable part may have a folded part folded in the direction reverse to the acoustic radiation direction, and the folded part may be connected to the outer peripheral surface of the voice coil bobbin. Or, the inner peripheral part of the movable part may have a folded part folded in the acoustic radiation direction, and the folded part may be connected to the outer peripheral surface of the voice coil bobbin. Namely, the folded part is preferably folded in the acoustic radiation direction or the direction reverse thereto. Thereby, the joint force between the damper and the voice coil bobbin can be enhanced.

In still another manner of the above speaker device, the vibration body may further include a diaphragm; the diaphragm may be arranged to cover the voice coil bobbin; an opening may be formed at the movable part of the damper; and a space formed between the damper and the diaphragm and a space formed between the first member of the damper and the magnetic circuit may communicate with each other via the opening formed at the movable part.

In this manner, the vibration body further includes the diaphragm. The diaphragm is arranged to cover the voice coil bobbin. The opening is formed at the movable part of the damper. The space formed between the damper and the diaphragm and the space formed between the first member of the damper and the magnetic circuit communicate with each other via the opening formed at the movable part of the damper.

In such a case that the movable part of the damper behaves in a long time, the air pressure in the space formed between the first member of the damper and the magnetic circuit becomes large. Therefore, there are such a problem that the movable part of the damper hardly behaves or such a problem that the movable part of the damper cannot behave in the direction reverse to the acoustic radiation direction. Hence, in this manner, by making the space formed between the diaphragm and the damper and the space formed between the magnetic circuit and the first member of the damper communicate with each other via the opening formed at the movable part of the damper, the air pressure does not become large, and it becomes possible to behave the movable part of the damper with the movement of the voice coil bobbin in a long time.

EMBODIMENT

Now, a description will be given of preferred embodiments of the present invention with reference to attached drawings.

First Embodiment

Configuration of Speaker Device

FIG. 1 shows a cross-sectional view of a speaker device 100 according to a first embodiment of the present invention, which is cut by a position passing through its central axis L1.

The speaker device 100 mainly includes: an internal magnet type magnetic circuit 30 having a yoke 1, a magnet 2 and a plate 3; a vibration body 31 including a voice coil bobbin 5, a voice coil 6, a damper 7 and a diaphragm 8; a frame (supporting body) 4; and a sound absorbing material 9.

Configuration of Magnetic Circuit

Now, a description will be given of the configuration of the magnetic circuit 30.

The yoke 1, which has a bottom part having a flat plate shape and which has a cylindrical shape formed to extend in the acoustic radiation direction from the bottom part, is mounted on a bottom surface of the frame 4 which will be explained later. The magnet 2 having a disc shape is mounted on a bottom surface of the yoke 1. The plate 3 having an annular shape is mounted on the magnet 2. A magnetic gap 32 on which a magnetic flux of the magnet 2 concentrates is formed between an outer peripheral surface of the plate 3 and an inner peripheral surface of an upper end part of the yoke 1.

Configuration of Vibration Body

The vibration body 31 includes the voice coil bobbin 5, the voice coil 6, the damper 7 and the diaphragm 8 as configuration members, which will be explained below.

The voice coil bobbin 5 having a cylindrical shape is arranged to surround the plate 3, the damper 7 and the sound absorbing material 9.

The voice coil 6, wounded around an outer peripheral surface of a lower end part of the voice coil bobbin 5, is positioned in the magnetic gap 32. The voice coil 6 has a pair of positive/negative lead wires (not shown). The lead wire on the positive side serves as input wiring for an L (or R) channel signal, and the lead wire on the negative side serves as input wiring for a ground (GND: earth) signal. The pair of positive/negative lead wires is electrically connected to an amplifier (not shown).

The damper 7 is arranged in a space formed by the voice coil bobbin 5. A lower end part of the damper 7 is mounted on an upper end surface of the plate 3, and an outer peripheral part of the damper 7 is connected to the inner peripheral surface of the voice coil bobbin 5. Therefore, the damper 7 has a function to elastically support the vibration body 31 including the voice coil bobbin 5 in the direction of the central axis L1. The sound absorbing material 9 formed with a material having permeability is mounted on an upper end surface 71*b* of the damper 7. The damper 7 will be explained in detail, later.

The diaphragm 8 having a dome shape is preferably made by a woven cloth and a nonwoven cloth made by fiber, and a fabric material in a sheet state formed by attaching an adhesive such as a resin to the woven cloth and the nonwoven cloth. The diaphragm 8 has a sound radiating part 8*a* having a function to radiate a sound wave in an acoustic radiation direction Y1, and an edge 8*b* which is formed to outwardly extend from the outer peripheral part of the sound radiating part 8*a* and which has a cross-sectional shape of a substantially half circle. The outer peripheral part of the sound radiating part 8*a* is connected to the outer peripheral surface of the upper end part of the voice coil bobbin 5, and the outer peripheral part of the edge 8*b* is mounted on the upper end part of the frame 4.

Configuration of Frame

The frame 4 having a bowl shape has a function to support the magnetic circuit 30 and the vibration body 31.

In the speaker device 100 including the above components, the sound current outputted from the amplifier is inputted to the voice coil 6 via the pair of positive/negative lead wires of the voice coil 6. Thereby, based on Fleming's left-hand rule, an electromagnetic force (Lorentz's force) operates on the voice coil 6 in the magnetic gap 32. Then, the voice coil 6 and the diaphragm 8 move together in the acoustic radiation direction Y1 and the reverse direction. Thereby, the sound wave is radiated in the acoustic radiation direction Y1 via the sound radiating part 8*a* of the diaphragm 8.

Configuration of Damper

Figure 2B:
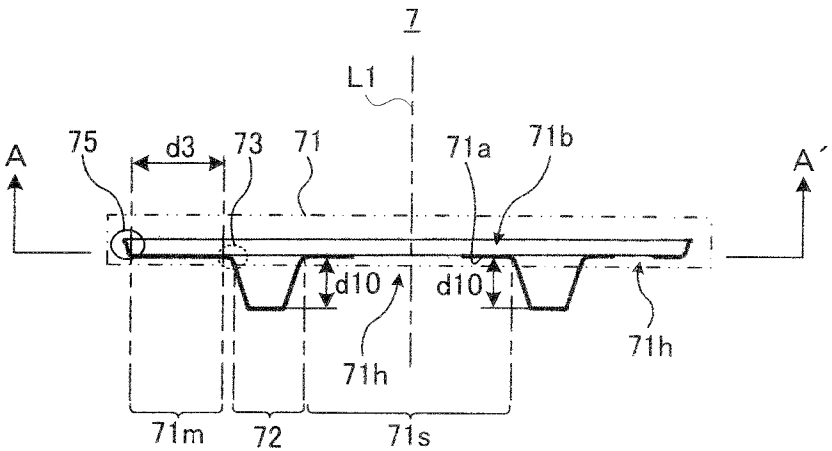
FIGS. 2A and 2B are a plan view and a cross-sectional view of a damper according to the first embodiment.

Next, a description will be given of a configuration of the damper 7 with reference to FIG. 1 and FIGS. 2A and 2B.

Figure 2A:
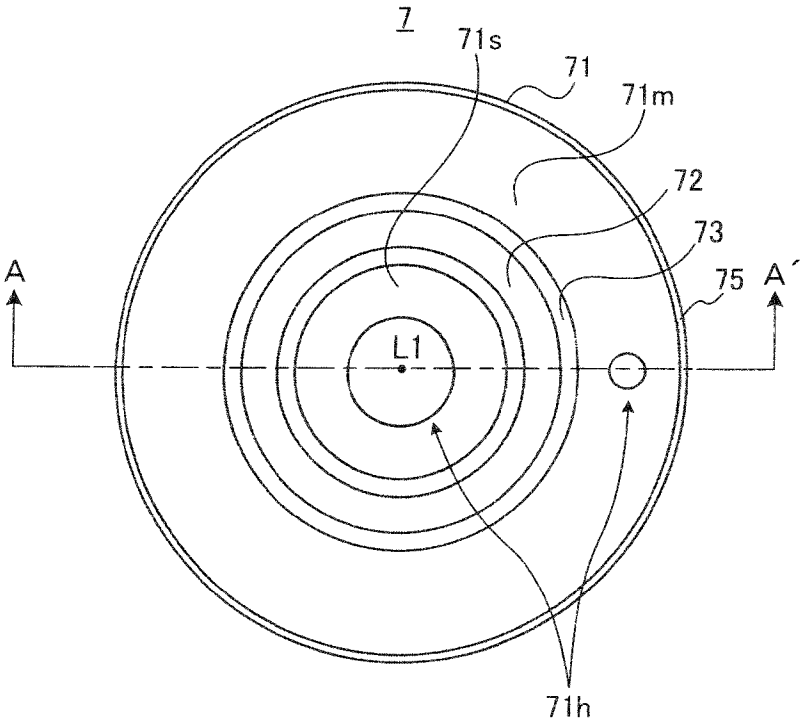

FIG. 2A shows a plane view of the damper 7 according to the first embodiment, when the damper is observed from the acoustic radiation direction Y1 shown in FIG. 1. FIG. 2B shows a cross-sectional view passing through the central axis L1 of the damper 7 along a cutting line A-A' shown in FIG. 2A.

The basic configuration of the damper 7 is as described above.

The damper 7, formed with the material in the film state, has a first member 71 (an area surrounded by a chain double-dashed line shown in FIG. 2B) having a disc shape, and a second member 72 provided to project from one end surface 71*a* of the first member 71. As the material in the film state, there is the resin film such as polyether imide (PEI), polypropylene, polyimide, polyphenylene sulfide, aramid, polycarbonate, and so on, for example.

The first member 71 has a movable part 71*m* having a function to elastically support the voice coil bobbin 5, and a flat part 71*s* surrounded by the second member 72.

Figure 4B:
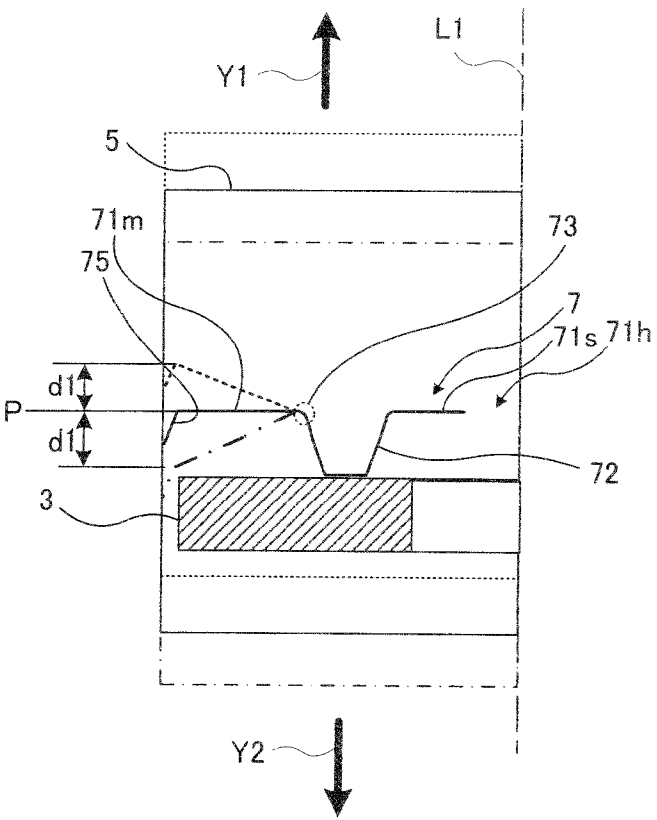
FIGS. 4A and 4B are cross-sectional views for explaining a movable principle of the damper according to the first embodiment.

The movable part 71*m*, having a flat plate shape and an annular plane shape, is provided to outwardly extend from a bent part 73 (a part surrounded by a broken line shown in FIG. 2B) formed between the movable part 71*m* and the second member 72 and to extend in the direction substantially orthogonal with respect to the central axis L1. A length d3 of the movable part 71*m* in the direction orthogonal with respect to the central axis L1 of the damper 7 is preferably formed as long as possible so that a movable area of the movable part 71*m* becomes large. At the movable part 71*m*, an opening 71*h* penetrating in the direction of the central axis L1 is formed. The outer peripheral part of the movable part 71*m* has a folded part 75 (an area surrounded by an actual line shown in FIG. 25, also see FIG. 4A) which is folded on the side of the upper end surface 71*b* of the first member 71, i.e., in the acoustic radiation direction Y1. In the present invention, the folded part 75 may be folded on the reverse side with respect to the upper end surface 71*b* of the first member 71 (i.e., in the reverse direction with respect to the acoustic radiation direction Y1), as shown in FIG. 4B. The folded part 75 has a function to enhance the joint force between the damper 7 and the voice coil bobbin 5.

The flat part 71*s*, formed into a disc shape, has a flat surface. The opening 71*h* penetrating in the direction of the central axis L1 is formed at the center of the flat part 71*s*. The sound absorbing material 9 is mounted on the upper end surface 71*b* of the first member 71 having the flat part 71*s*, as shown in FIG. 1. Since the flat part 71*s* has a flat surface, the sound absorbing material 9 can be stably mounted on the upper end surface 71*b* of the damper 7 having the flat part 71*s*.

Figure 3:
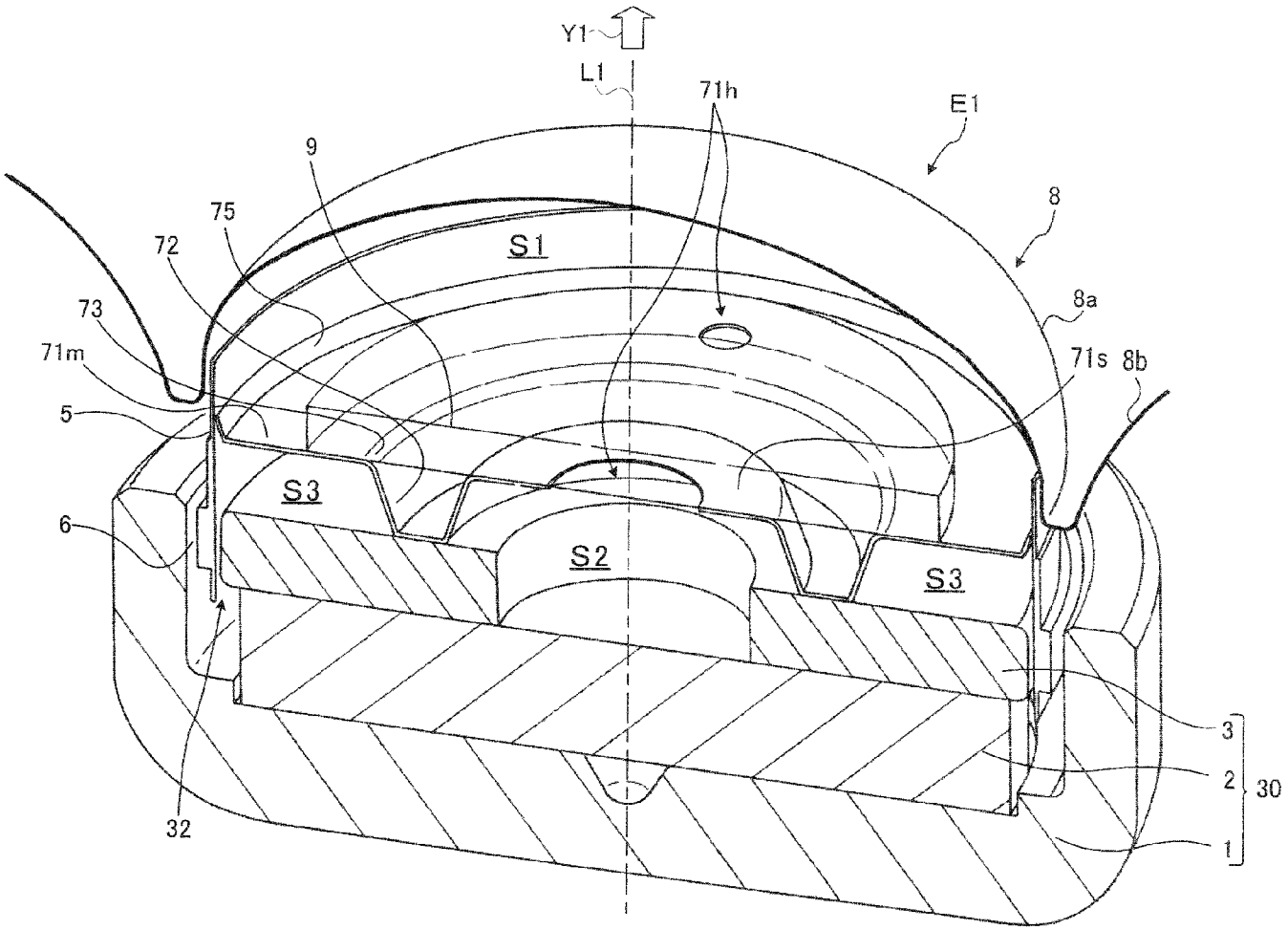
FIG. 3 is a perspective cross-sectional view of an enlarged main part of a mounting configuration of the damper according to the first embodiment.

The second member 72 is provided between the movable part 71*m* and the flat part 71*s*, and has a shape to project toward the plate 3. As shown in FIG. 1 and FIG. 3, the second member 72 has a length d10 which forms a predetermined gap between the first member 71 and the plate 3 opposite to the first member 71, and which enables the movable part 71*m* to behave with respect to the bent part 73 in the direction of the central axis L1.

Configuration of Mounting Damper

Next, a description will be given of a configuration of mounting the damper 7 on the voice coil bobbin 5 and the plate 3, with reference to FIG. 3.

FIG. 3 is a perspective view of an enlarged main part, in which a broken-line area E1 shown in FIG. 1 is enlarged. Particularly, FIG. 3 shows the configuration of mounting the damper 7 on the voice coil bobbin 5 and the plate 3. In addition, FIG. 3 is a perspective view of the sound absorbing material 9, too.

In the space formed by the voice coil bobbin 5, the damper 7 is arranged so that the first member 71 is opposite to the plate 3 and the movable part 71*m* of the first member 71 is arranged to extend on the side of the voice coil bobbin 5 with respect to the bent part 73 and in the direction substantially orthogonal with respect to the acoustic radiation direction Y1, and further the second member 72 is arranged to project on the side reverse to the acoustic radiation direction Y1 and toward the plate 3. The outer peripheral part of the movable part 71*m* of the first member 71, i.e., the folded part 75 which is folded in the acoustic radiation direction Y1, is connected to the inner peripheral surface of the voice coil bobbin 5 via the adhesive, and the second member 72 is mounted on the plate 3 via the adhesive.

Movable Principle of Damper

Next, a description will be given of a movable principle of the damper 7 with reference to FIG. 4A.

Figure 4A:
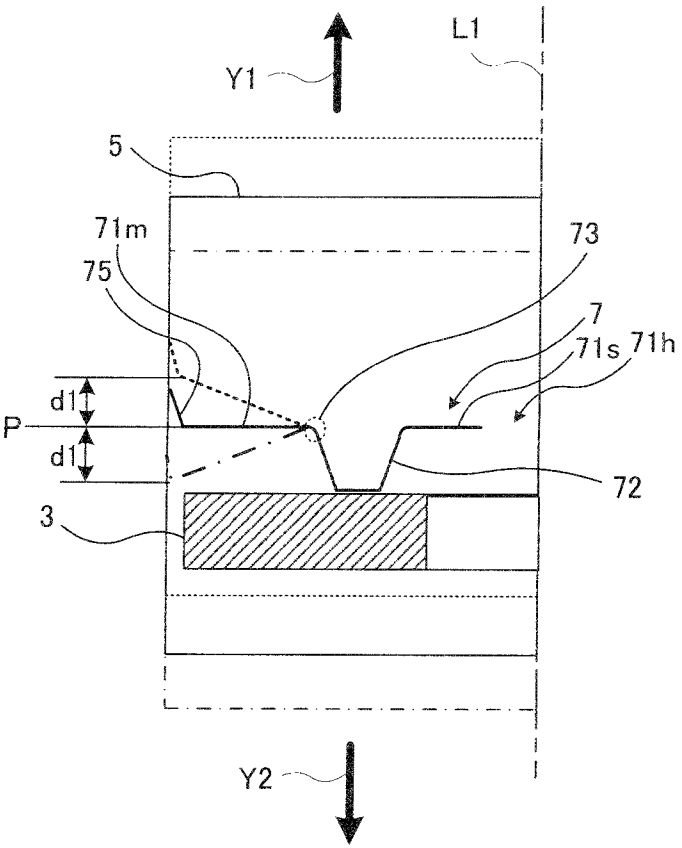

FIG. 4A is a cross-sectional view schematically showing the configuration of mounting the damper 7 on the voice coil bobbin 5 and the plate 3, and it is particularly a diagram for explaining the movable principle of the damper 7. In FIG. 4A, only basic components are illustrated for convenience of an explanation.

When the speaker device 100 drives, the movable part 71*m* of the damper 7 behaves in the moving direction of the voice coil bobbin 5 with respect the bent part 73 formed between the movable part 71*m* and the second member 72 with the movement of the voice coil bobbin 5 in the direction of the central axis L1.

Namely, as shown by a rectangular broken-lined part in FIG. 4A, when the voice coil bobbin 5 moves to the acoustic radiation direction. Y1, the movable part 71*m* behaves with respect to the bent part 73, as shown by a hook-shaped broken-lined part. Meanwhile, in FIG. 4A, when the voice coil bobbin 5 moves in an direction Y2 reverse to the acoustic radiation direction Y1 as shown by the rectangular chain-lined part, the movable part 71*m* behaves with respect to the bent part 73, as shown by the hook-shaped chain-lined part. At this time, the sound current is inputted to the voice coil 6 so that the movement distance of the voice coil bobbin 5 in the acoustic radiation direction Y1 is substantially equal to the movement distance of the voice coil bobbin 5 in the direction Y2 reverse to the acoustic radiation direction Y1. In this method, the damper 7 elastically supports the vibration body 31 including the voice coil bobbin 5 in the direction of the central axis L1.

Next, a description will be given of a characteristic point of the damper 7 according to the first embodiment.

Particularly, the movable part 71*m* of the damper 7, having the flat plate shape, behaves with respect to the bent part 73 with the movement of the voice coil bobbin 5 in the acoustic radiation direction Y1 and the reverse direction Y2. Thus, as shown in FIG. 4A, a displacement d1 of the damper 7 with respect to a rest position P in such a case that the damper 7 behaves in the acoustic radiation direction Y1 is substantially equal to the displacement d1 of the damper 7 with respect to the rest position P in such a case that the damper 7 behaves in the direction Y2 reverse to the acoustic radiation direction Y1.

Hence, when a constant force is given to the damper 7 via the voice coil 6, the displacement of the damper 7 with respect to the rest position P can be substantially similar in the cases that the damper 7 behaves in the acoustic radiation direction Y1 and in the direction Y2. Hence, the high linearity characteristic can be obtained.

Moreover, since the damper 7 has the movable part 71*m*, the damper 7 flexibly behaves in correspondence with the movement of the voice coil bobbin 5, as compared with the corrugation-shaped damper (corrugation damper). Therefore, the rolling phenomena (rolling of the vibration body) can be suppressed.

The damper 7 is formed in the film state formed with the material such as a thin resin film. Therefore, the movable part 71*m* of the damper 7 can easily follow the movement of the voice coil bobbin 5. From this point, the high linearity characteristic can be also obtained. Additionally, since the weight of the damper 7 can be reduced, the total weight of the vibration body 31 can be reduced, too. Therefore, the sensitivity of the speaker device 100 can be improved.

On the other hand, the speaker device including no sound absorbing material 9 on the flat part 71*s* of the damper 7 has a problem, which will be explained below.

That is, when the speaker device drives, the damper 7 behaves with the voice coil bobbin 5. Thereby, an unnecessary sound wave is radiated from the damper 7 toward the sound radiating part 8*a* of the diaphragm 8. At the same time, the sound wave is also radiated from the sound radiating part 8*a* of the diaphragm 8 toward the damper 7, and the sound wave hits the damper 7 and reflects. The unnecessary reflected sound wave is radiated toward the sound radiating part 8*a* of the diaphragm 8. Moreover, the sound wave radiated from the sound radiating part 8*a* of the diaphragm 8 toward the damper 7 causes an abnormal vibration to the damper 7, and thereby, the unnecessary sound wave is radiated from the damper 7 toward the sound radiating part 8*a* of the diaphragm 8. At this time, the unnecessary vibration occurring to the damper 7 is transmitted to the diaphragm 8. Therefore, in such a configuration, the sound quality deteriorates due to the above unnecessary sound wave and vibration.

In this point, since the speaker device 100 includes the sound absorbing material 9 having permeability on the flat part 71*s* of the damper 7 positioned on the side of the sound radiating part 8*a* of the diaphragm 8, most of the unnecessary sound wave and vibration is absorbed by the sound absorbing material 9, and the deterioration of the sound quality can be prevented.

Now, the description will be returned to the explanation of FIG. 3. In the speaker device 100, the sound radiating part 8*a* of the diaphragm 8 is arranged to cover the voice coil bobbin 5, and a first space S1 is formed between the sound outputting unit 8*a* and the damper 7. Also, a second space S2 is formed between the plate 3 and the magnet 2 and the flat part 71*s* of the damper 7. The first space S1 and the second space S2 communicate with each other via the opening 71*h* provided at the flat part 71*s* and the sound absorbing material 9 provided on the flat part 71*s*. Therefore, the low frequency reproduction limit can be lower.

Namely, as the volume of the first space S1 provided between the sound radiating part 8*a* of the diaphragm 8 and the damper 7 becomes large, the elastic force (force of air spring) of the compressed air in the first space S1 becomes small. With using the force of the air spring, the low frequency reproduction limit can be lower. In this point, by the configuration, since the second space S2 is added to the first space S1, the volume of the space on the back side of the sound radiating part 8*a* becomes large by the amount. As a result, since the force of the air spring in the second space S2 becomes small, the low frequency reproduction limit can be lower.

In the speaker device 100, a third space S3 is further formed between the movable part 71*m* of the damper 7 and the plate 3, and the first space S1 and the third space S3 communicate with each other via the opening 71*h* provided at the movable part 71*m*. Thereby, since the third space S3 is added to the first space S1, the volume of the space on the back side of the sound radiating part 8*a* becomes large by the amount. As a result, since the force of the air spring in the third space S3 becomes small, the low frequency reproduction limit can be lower.

Also, the space S1 formed between the damper 7 and the diaphragm 8 and the space S3 formed between the first member 71 of the damper 7 and the magnetic circuit 30 communicate with each other via the opening 71*h* formed at the movable part 71*m* of the damper 7.

In such a case that the movable part 71*m* of the damper 7 behaves in a long time, the air pressure in the space S3 formed between the first member 71 of the damper 7 and the magnetic circuit 30 becomes large. At this time, there is such a problem that the movable part 71*m* of the damper 7 hardly behaves, or that the movable part 71*m* of the damper 7 cannot behave in the direction reverse to the acoustic radiation direction Y1. Hence, as described in the first embodiment, by making the first space 51 formed between the diaphragm 8 and the damper 7 and the third space S3 formed between the magnetic circuit 30 and the first member 71 of the damper 7 communicate with each other via the opening 71*h* formed at the movable part 71*m* of the damper 7, it becomes possible that the air pressure does not become large and the movable part 71*m* of the damper 7 can behave with the movement of the voice coil bobbin 5 in the long time.

Second Embodiment

Next, a description will be given of a configuration of a speaker device 200 according to a second embodiment of the present invention with reference to FIG. 5. Hereinafter, the same reference numerals are given to the same components as those of the first embodiment, and explanations thereof are omitted.

Configuration of Speaker Device

Figure 5:
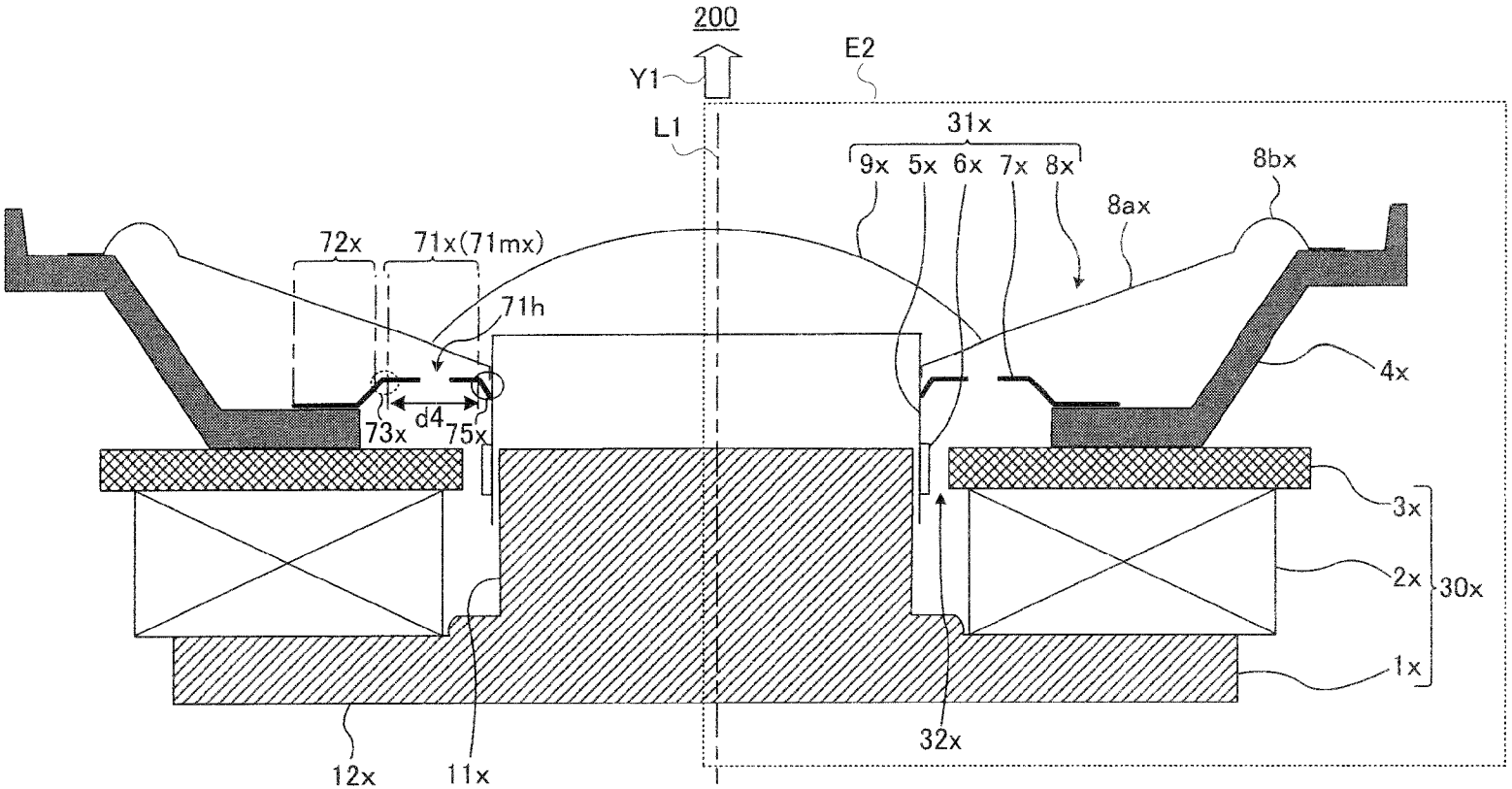
FIG. 5 is a cross-sectional view of a speaker device according to a second embodiment of the present invention.

FIG. 5 shows a cross-sectional view of the speaker device 200 according to the second embodiment of the present invention in such a case that the speaker device 200 is cut at the position passing through the central axis L1.

The speaker device 200 mainly comprises: an external-magnet type magnetic circuit 30*x* having a yoke 1*x*, a magnet 2*x* and a plate 3*x*; a vibration body 31*x* including a voice coil bobbin 5*x*, a voice coil 6*x*, a damper 7*x*, a diaphragm 8*x* and a cap 9*x*; and a frame (supporting body) 4*x*.

Configuration of Magnetic Circuit

Now, the configuration of the magnetic circuit 30*x* will be explained.

The yoke 1*x*, having an upside-down T-shaped cross section, has a cylindrical center pole 11*x* and a flange part 12*x* outwardly extending from the lower end part of the outer peripheral surface of the center pole 11*x*. The magnet 2*x*, having an annular shape, is mounted on the flange part 12*x* of the yoke lx. The plate 3*x*, having an annular shape, is mounted on the magnet 2*x*. A magnetic gap 32*x* on which the magnetic flux of the magnet 2*x* concentrates is formed between the inner peripheral surface of the plate 3*x* and an the outer peripheral surface of the upper end part of the center pole 11*x*.

Configuration of Vibration Body

The vibration body 31*x* has the voice coil bobbin 5*x*, the voice coil 6*x*, the damper 7*x* and the diaphragm 8*x* as the component members, and each of them will be now explained.

The voice coil bobbin 5*x*, having a cylindrical shape, is arranged to surround the upper end part of the center pole 11*x*.

The voice coil 6*x* is wound around the outer peripheral surface of the lower end part of the voice coil bobbin 5*x*, and is positioned in the magnetic gap 32*x*. The voice coil 6*x* has a pair of positive/negative lead wires (not shown). The lead wire on the positive side serves as input wiring for an L (or R) channel signal, and the lead wire on the negative side serves as input wiring for a ground (GND: earth) signal. The pair of positive/negative lead wires is electrically connected to an amplifier (not shown).

The damper 7*x* is formed with the same material as that of the above damper 7. The damper 7*x* has the shape for surrounding the voice coil bobbin 5*x*. Concretely, the damper 7*x* has a shape formed by combining: a first member 71*x* which is arranged opposite to the outer peripheral surface of the voice coil bobbin 5*x* with a constant space, and which has an annular shape; a second member 72*x* which is bent toward the lower end portion of the frame 4*x* from the outer peripheral edge part of the first member 71*x*, which has a shape parallel to the frame 4*x* and outwardly extending, and which has a shape projecting toward the lower end part of the frame 4*x*; and a folded part 75*x* which has a shape folded toward the outer peripheral surface of the voice coil bobbin 5 from the inner peripheral edge part of the first member 71*x* and on the side reverse to the acoustic radiation direction Y1.

Figure 7:
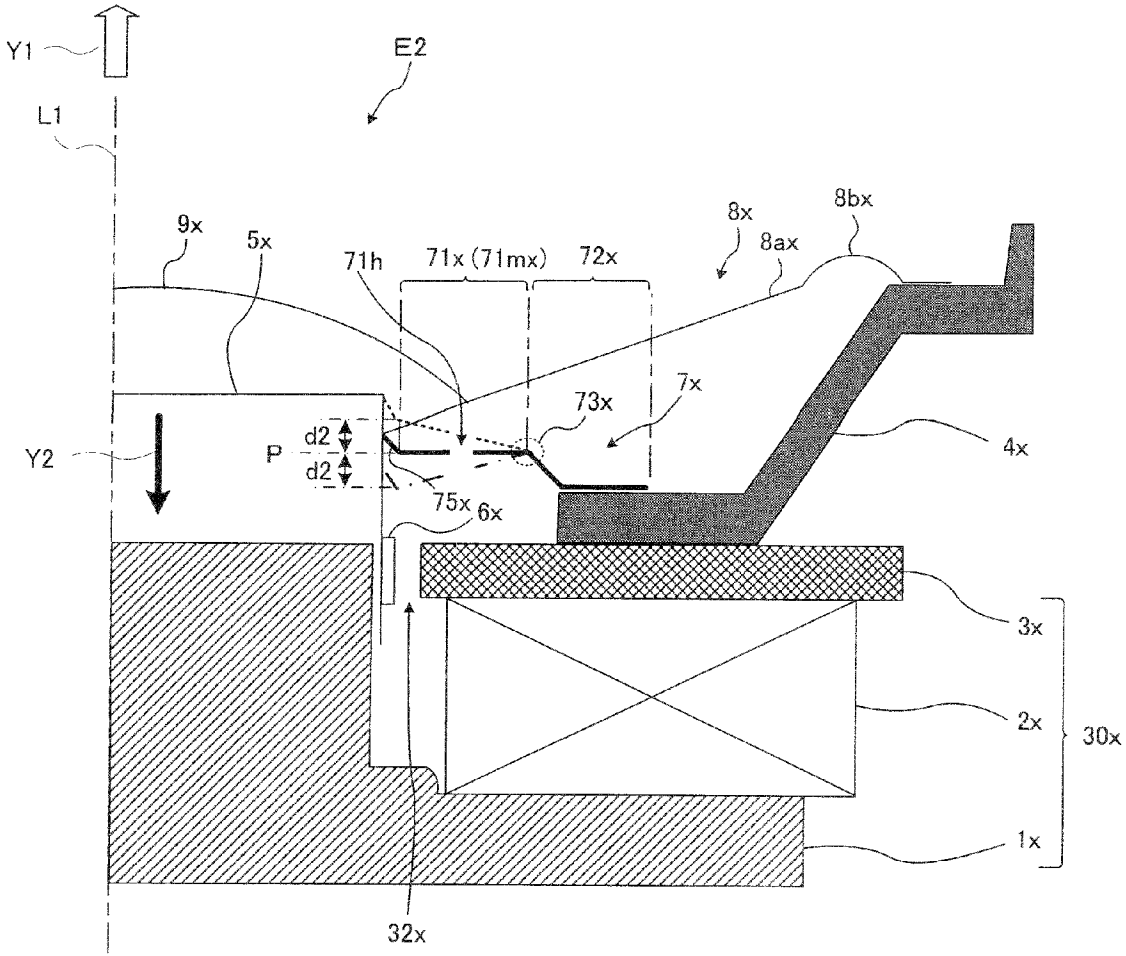
FIG. 7 is a cross-sectional view of a speaker device including a damper according to another form of the second embodiment.
Figure 8:
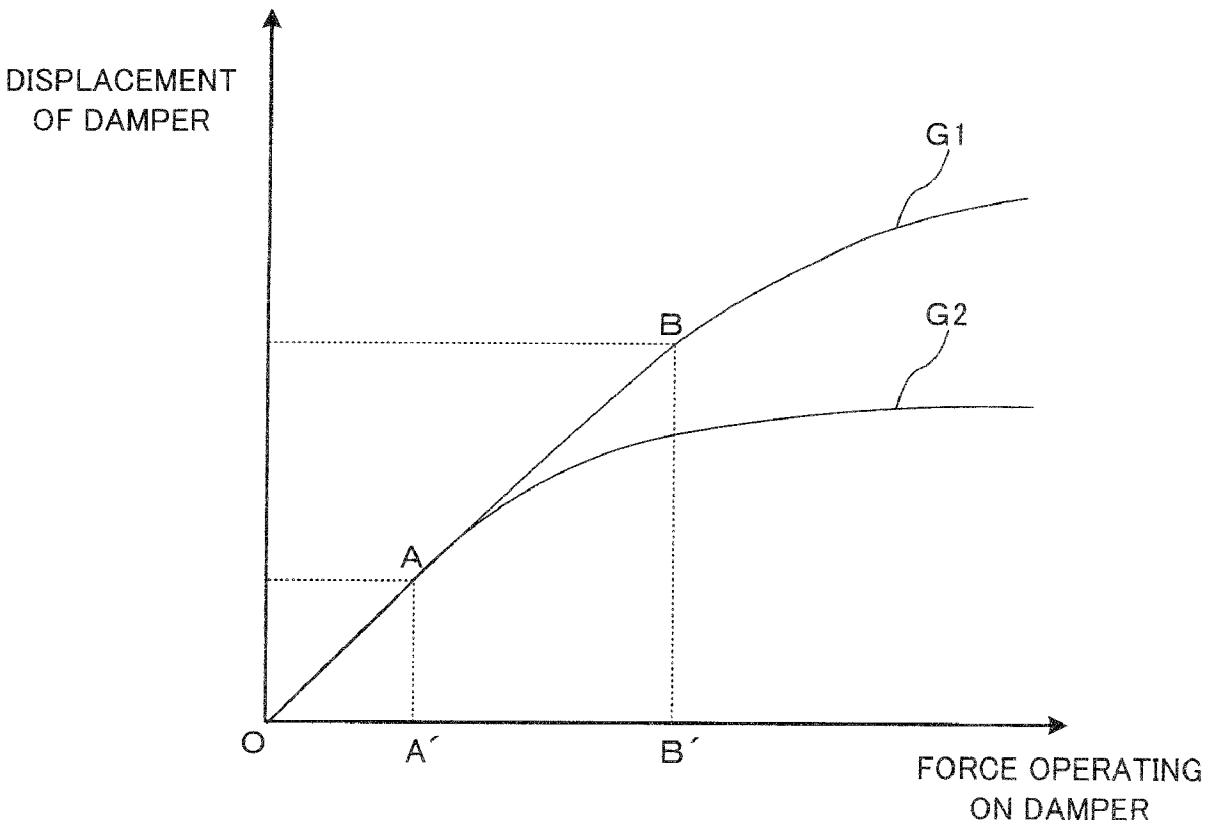
FIG. 8 is a graph for explaining a linearity characteristic of a damper according to a normal technique.

The first member 71*x* has a movable part 71*mx* for elastically supporting the voice coil bobbin 5. The movable part 71*mx*, having a flat plate shape, is provided to extend on the side of the voice coil bobbin 5*x* from a bent part 73*x* formed between the movable part 71*mx* and the second member 72*x* and in the direction substantially orthogonal with respect to the acoustic radiation direction Y1. A length d4 of the movable part 71*mx* in the direction substantially orthogonal with respect to the central axis L1 of the damper 7*x* is preferably formed as long as possible so that the movable area of the movable part 71*mx* becomes large. The inner peripheral part of the movable part 71*mx* has the folded part 75*x* folded on the side reverse to the acoustic radiation direction Y1. In the present invention, the folded part 75*x* may be folded in the acoustic radiation direction Y1, as shown in FIG. 7. The folded part 75*x* is connected to the outer peripheral surface of the voice coil bobbin 5*x*, and the second member 72*x* of the damper 7*x* is connected to the lower end part of the frame 4*x*.

The diaphragm 8*x*, having a cone shape, is preferably made by a woven cloth and a nonwoven cloth made by fiber, and the fabric material in the sheet state formed by attaching the adhesive such as the resin to the woven cloth and the nonwoven cloth. The diaphragm 8*x* has a sound radiating part 8*ax* having a function to radiate the sound wave in the acoustic radiation direction Y1 and an edge 8*bx* formed outwardly from the outer peripheral part of the sound radiating part 8*ax* and having a substantially half circular cross section. The inner peripheral part of the sound radiating part 8*ax* is connected to the outer peripheral surface of the upper end part of the voice coil bobbin 5*x*, and the outer peripheral part of the edge 8*bx* is connected to the upper end part of the frame 4*x*.

The cap 9*x*, having a dome shape, is mounted on the sound radiating part 8*ax* of the diaphragm 8*x* to cover the upper end part of the voice coil bobbin 5*x*.

Configuration of Frame

The frame 4*x*, having a bowl shape and an annular plane shape, is arranged to surround the voice coil bobbin 5*x*. The frame 4*x* has a function to support the magnetic circuit 30*x* and the vibration body 31*x*.

In the speaker device 200 having the above-mentioned configuration, the sound current outputted from the amplifier is inputted to the voice coil 6*x* via the pair of positive/negative lead wires of the voice coil 6*x*. Thereby, based on Fleming's left-hand rule, the electromagnetic force (Lorentz's force) operates on the voice coil 6*x* in the magnetic gap 32*x*. Then, the voice coil 6*x* and the diaphragm 8*x* move together in the acoustic radiation direction Y1 and the reverse direction. Thereby, the sound wave is radiated in the acoustic radiation direction Y1 via the sound radiating part 8*ax* of the diaphragm 8*x*.

Movable Principle of Damper

Next, a description will be given of a movable principle of the damper 7*x* with reference to FIG. 6.

Figure 6:
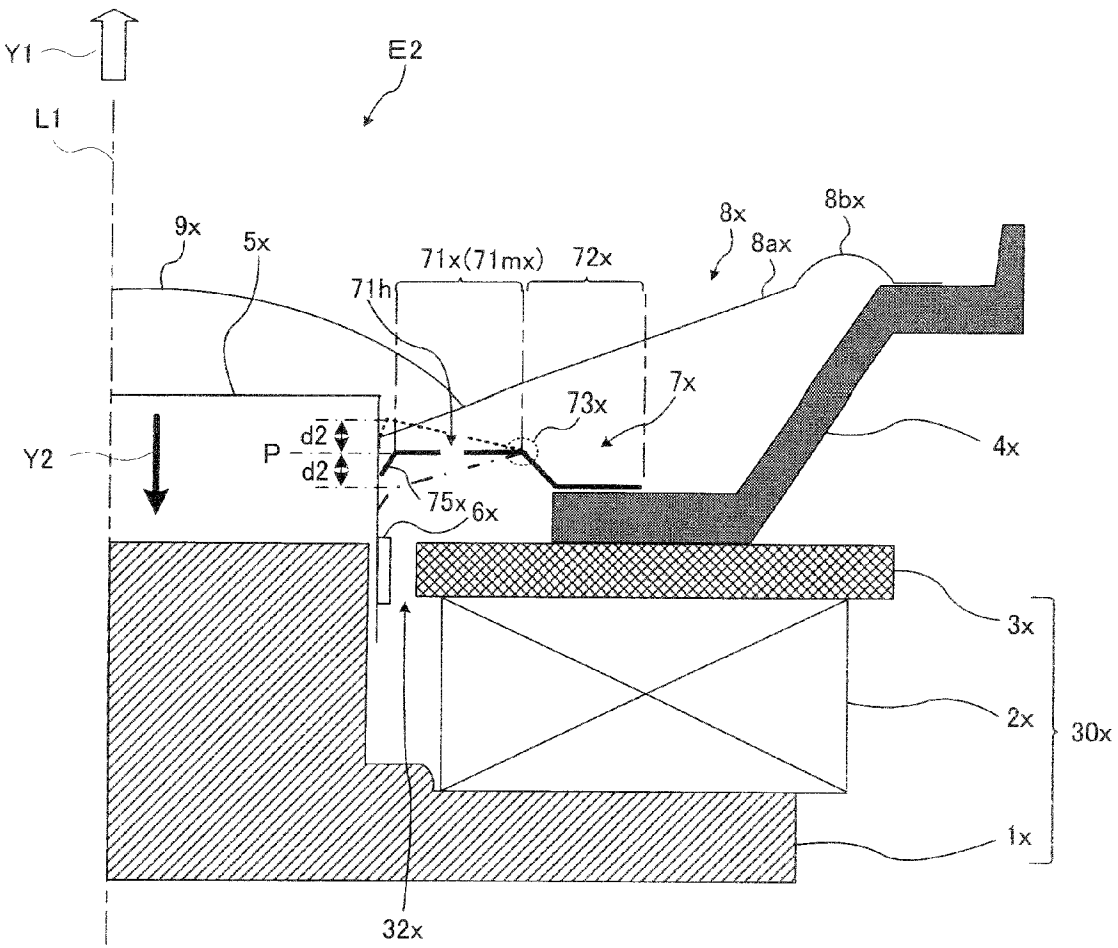
FIG. 6 is a cross-sectional view for explaining a mounting configuration and a movable principle of the damper according to the second embodiment.

FIG. 6 is a one-side cross-sectional view of the speaker device 200 corresponding to a broken-line area E2 shown in FIG. 5. In addition, FIG. 6 is a cross-sectional view schematically showing the mounting configuration of the damper 7*x* on the voice coil bobbin 5*x* and the frame 4*x*, and particularly explains the movable principle of the damper 7*x*.

When the speaker device 200 drives, the movable part 71*mx* of the damper 7*x* behaves with respect to the bent part 73*x* formed between the movable part 71*mx* and the second member 72*x* with the movement of the voice coil bobbin 5*x* in the direction of the central axis L1.

Namely, in FIG. 6, when it is assumed that the voice coil bobbin 5*x* moves in the acoustic radiation direction Y1, the movable part 71*mx* behaves with respect to the bent part 73*x*, as shown by a hook-shaped broken-lined part. Meanwhile, in FIG. 6, when it is assumed that the voice coil bobbin 5*x* moves in the direction Y2 reverse to the acoustic radiation direction Y1, the movable part 71*mx* behaves with respect to the bent part 73*x*, as shown by a hooked-shaped chain-lined part. At this time, the sound current is inputted to the voice coil 6*x* so that the movement distance of the voice coil bobbin 5*x* to the acoustic radiation direction Y1 is substantially similar to the movement distance of the voice coil bobbin 5*x* to the direction Y2 reverse to the acoustic radiation direction Y1. In this manner, the damper 7*x* elastically supports the vibration body 31*x* including the voice coil bobbin 5*x* and all that in the direction of the central axis L1.

Next, a description will be given of a characteristic point of the damper 7*x* according to the second embodiment.

Particularly, the movable part 71*mx* of the damper 7*x*, having a flat plate shape, behaves with respect to the bent part 73*x* with the movement of the voice coil bobbin 5*x* in the acoustic radiation direction Y1 and the reverse direction Y2. Therefore, as shown in FIG. 6, the displacement d2 of the damper 7*x* with respect to the rest position P in such a case that the damper 7*x* behaves in the acoustic radiation direction Y1 is substantially similar to the displacement d2 of the damper 7*x* with respect to the rest position P in such a case that the damper 7*x* behaves in the direction Y2 reverse to the acoustic radiation direction Y1.

Hence, when the constant force is given to the damper 7*x* via the voice coil 6*x*, the displacement of the damper 7*x* with respect to the rest position P can be substantially similar in the case that the damper 7*x* behaves in the direction Y2 reverse to the acoustic radiation direction Y1 and in the acoustic radiation direction Y1. Therefore, the high linearity characteristic can be obtained.

The damper 7*x* is formed into the film state by the material such as a thin resin film, like the above-mentioned damper 7. Therefore, the movable part 71*mx* of the damper 7*x* can easily follow the movement of the voice coil bobbin 5*x*. From this point, the high linearity characteristic can be obtained, too. Thereby, since the weight of the damper 7 can be reduced, the total weight of the vibration body 31*x* can be reduced, and the sensitivity of the speaker device 200 can be improved.

Additionally, the space formed between the damper 7*x* and the diaphragm 8*x* and the space formed between the first member 71*x* of the damper 7*x* and the magnetic circuit 30 communicate with each other via the opening 71*h* formed at the movable part 71*m* of the damper 7.

In such a case that the movable part 71*mx* of the damper 7*x* behaves in a long time, the air pressure in the space formed between the first member 71*x* of the damper 7*x* and the magnetic circuit 30*x* becomes large, there is such a problem that the movable part 71*mx* of the damper 7*x* hardly behaves or the movable part 71*mx* of the damper 7*x* cannot behave in the direction reverse to the acoustic radiation direction Y1. Thus, similarly to the second embodiment, by making the space formed between the diaphragm 8*x* and the damper 7*x* and the space formed between the magnetic circuit 30*x* and the first member 71*x* of the damper 7*x* communicate with each other via the opening 71*h* formed at the movable part 71*mx* of the damper 7*x*, the air pressure does not become large, and the movable part 71*mx* of the damper 7*x* can behave with the movement of the voice coil bobbin 5*x* in the long time.

INDUSTRIAL APPLICABILITY

This invention can be used as an on-vehicle speaker, a speaker for mobile electronics and/or an indoor speaker.

The invention claimed is:

1. A speaker device comprising: a vibration body including a damper and a voice coil bobbin; and a magnetic circuit, wherein the damper includes a first member arranged opposite to the magnetic circuit and a second member provided to project toward the magnetic circuit from the first member, wherein the first member of the damper includes a movable part which elastically supports the voice coil bobbin, and the movable part is provided to extend toward the voice coil bobbin from a bent part formed between the movable part and the second member, wherein an outer peripheral part of the movable part is mounted on an inner peripheral surface of the voice coil bobbin, and the second member of the damper is arranged on the magnetic circuit, and wherein the movable part of the damper has a flat plate shape, and behaves with respect to the bent part with a movement of the voice coil bobbin to an acoustic radiation direction and a direction reverse to the acoustic radiation direction.

2. A speaker device comprising: a supporting body; and a vibration body including a damper supported by the supporting body and a voice coil bobbin, wherein the supporting body is provided to surround the voice coil bobbin, wherein the damper includes a first member, having an annular shape, arranged opposite to an outer peripheral surface of the voice coil bobbin and a second member provided to project toward the supporting body from the first member, wherein the first member of the damper includes a movable part which elastically supports the voice coil bobbin, and the movable part is provided to extend toward the voice coil bobbin from a bent part formed between the movable part and the second member, wherein an inner peripheral part of the movable part is connected to the outer peripheral surface of the voice coil bobbin, and the second member of the damper is connected to the supporting body, and wherein a whole part of the movable part of the damper is substantially flat, and the moveable part of the damper behaves with respect to the bent part with a movement of the voice coil bobbin to an acoustic radiation direction and a direction reverse to the acoustic radiation direction.

3. The speaker device according to claim 1, wherein the damper is formed with a material in a film state.

4. The speaker device according to claim 1, wherein the vibration body further includes a diaphragm, wherein the diaphragm is arranged to cover the voice coil bobbin and the damper, wherein the first member of the damper has a flat part surrounded by the second member, and wherein a sound absorbing material is mounted on the flat part positioned on a side of the diaphragm.

5. A speaker device according to claim 1, wherein the vibration body further includes a diaphragm, wherein the diaphragm is arranged to cover the voice coil bobbin and the damper, wherein the first member of the damper has a flat part surrounded by the second member, wherein a first space is formed between the diaphragm and the damper, and a second space is formed between the magnetic circuit and the flat part, and wherein the first space and the second space communicate with each other via an opening provided at the flat part.

6. The speaker device according to claim 1, wherein the vibration body further includes a diaphragm, wherein the diaphragm is arranged to cover the voice coil bobbin and the damper, wherein the first member of the damper has a flat part surrounded by the second member, wherein a first space is formed between the diaphragm and the damper, and a third space is formed between the movable part and the magnetic circuit, and wherein the first space and the third space communicate with each other via an opening provided at the movable part.

7. The speaker device according to claim 1, wherein the second member of the damper forms a predetermined gap between the first member and the magnetic circuit opposite to the first member, and the movable part behaves with respect to the bent part in the acoustic radiation direction and the direction reverse to the acoustic radiation direction.

8. The speaker device according to claim 1, wherein the outer peripheral part of the movable part has a folded part folded in the acoustic radiation direction, and wherein the folded part is connected to the inner peripheral surface of the voice coil bobbin.

9. The speaker device according to claim 1, wherein the outer peripheral part of the movable part has a folded part folded in the direction reverse to the acoustic radiation direction, and wherein the folded part is connected to the inner peripheral surface of the voice coil bobbin.

10. The speaker device according to claim 2, wherein the inner peripheral part of the movable part has a folded part folded in the direction reverse to the acoustic radiation direction, and wherein the folded part is connected to the outer peripheral surface of the voice coil bobbin.

11. The speaker device according to claim 2, wherein the inner peripheral part of the movable part has a folded part folded in the acoustic radiation direction, and wherein the folded part is connected to the outer peripheral surface of the voice coil bobbin.

12. The speaker device according to claim 2, wherein the vibration body further includes a diaphragm, wherein the diaphragm is arranged to cover the voice coil bobbin, wherein an opening is formed at the movable part of the damper, and wherein a space formed between the damper and the diaphragm and a space formed between the first member of the damper and the magnetic circuit communicate with each other via the opening formed at the movable part.

13. The speaker device according to claim 2, wherein the damper is formed with a material in a film state.

* * * * *